United States Patent [19]

Appleby

[11] 4,399,832

[45] Aug. 23, 1983

[54] AIR GAP ASSEMBLY

[75] Inventor: Robert A. Appleby, Redwood City, Calif.

[73] Assignee: The Mundo Corporation, Burlingame, Calif.

[21] Appl. No.: 265,470

[22] Filed: May 20, 1981

[51] Int. Cl.[3] ..... F16K 24/00

[52] U.S. Cl. ..... 137/216; 137/359

[58] Field of Search ..... 137/216, 359; 285/154

[56] References Cited

U.S. PATENT DOCUMENTS

| | | | |
|---|---|---|---|
| 3,155,106 | 11/1964 | Baron | 137/216 |
| 3,183,923 | 5/1965 | Hendrikson | 137/216 |
| 3,425,438 | 2/1969 | Suffron | 137/216 |
| 3,512,545 | 5/1970 | Weaver | 137/216 |
| 3,929,149 | 12/1975 | Phillips | 137/216 |

*Primary Examiner*—Gerald A. Michalsky

*Attorney, Agent, or Firm*—Flehr, Hohbach, Test, Albritton & Herbert

[57] ABSTRACT

Air gap assembly for preventing backflow from a waste line to a dishwasher or other appliance connected to the line. The assembly comprises a vertically extending hollow body, an inlet tube extending upwardly within the body, an outlet tube connected to the body, an air vent in the body in proximity to the upper portion of the inlet tube, and a deflector cap mounted on the body above the inlet tube. Water entering the device through the inlet tube is deflected in a downward direction toward the outlet tube without leakage through the air vents, and the air vents prevent syphoning action which might otherwise produce undesired backflow from the waste line to the appliance connected to the inlet tube.

5 Claims, 3 Drawing Figures

AIR GAP ASSEMBLY

This invention pertains generally to plumbing fixtures and more particularly to an air gap assembly for preventing backflow from a waste line to an appliance connected to the line.

Under certain conditions syphoning can produce an undesired backflow from a waste line to a dishwasher or other appliance connected to the lines. To prevent this syphoning action, an air gap or vent is introduced into the system between the appliance and the waste line. In some areas, the use of an air gap is required by the local building and/or plumbing codes.

It is in general an object of the invention to provide a new and improved air gap assembly for preventing backflow from a waste line to an appliance connected to the line.

Another object of the invention is to provide an air gap assembly of the above character which overcomes the limitations and disadvantages of air gap devices heretofore provided.

Another object of the invention is to provide an air gap assembly which is economical to manufacture and easy to install.

These and other objects are achieved in accordance with the invention by providing an air gap assembly having a vertically extending hollow body, an inlet tube extending upwardly within the body, an outlet tube connected to the body, an air vent in the body in proximity to the upper portion of the inlet tube, and a deflector cap mounted on the body above the inlet tube. The deflector cap has a depending skirt which is interposed between the upper portion of the tube and the air vent and extends downwardly to a level below the air vent. In one presently preferred embodiment, the body is provided with two air vents, and the deflector cap is secured to the body by a pair of depending hooks which engage the air vents.

Figure 1:
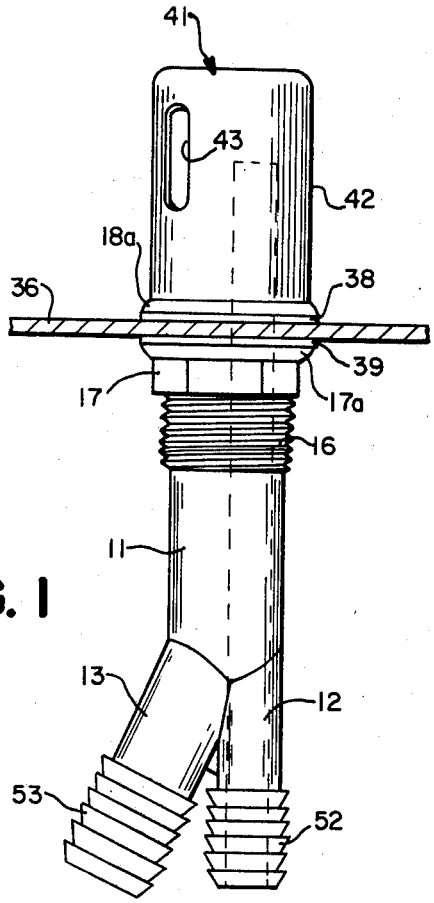
FIG. 1 is a side elevational view, of one embodiment of an air gap assembly according to the invention.
Figure 2:
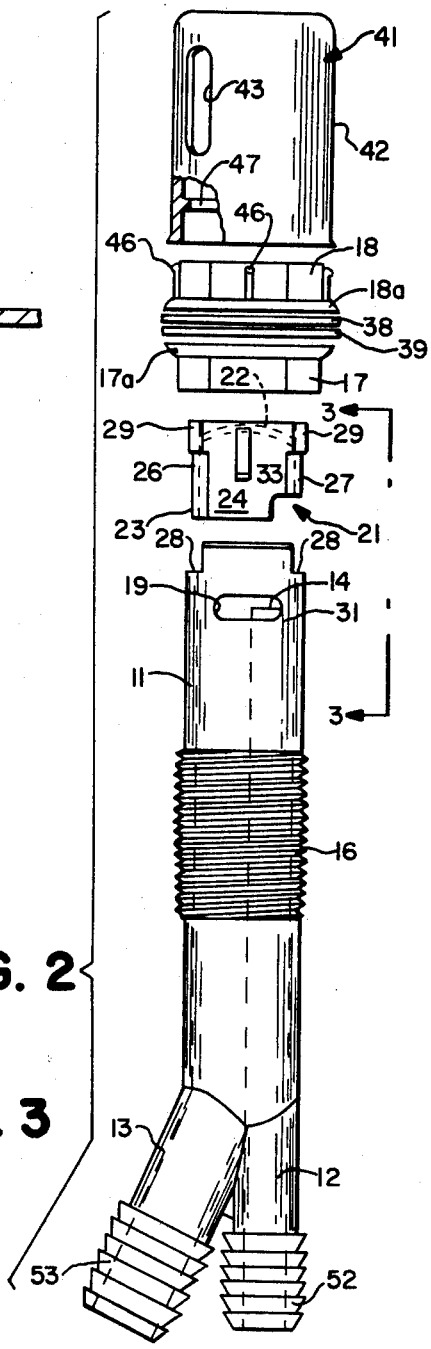
FIG. 2 is an exploded side elevational view, partly broken away, of the embodiment of FIG. 1.
Figure 3:
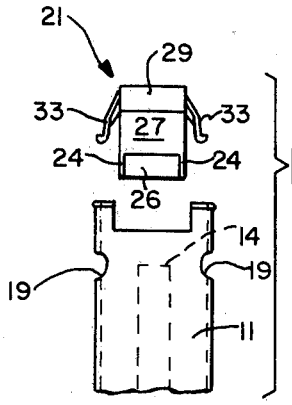
FIG. 3 is a fragmentary exploded view taken along line 3—3 in FIG. 2.

As illustrated in the drawings, the air gap assembly includes a vertically extending hollow body 11 having an inlet tube 12 and an outlet tube 13 extending from the lower portion thereof. The inlet tube extends upwardly within the hollow body and communicates with the interior of the body through an opening 14 at the top of the tube. The outlet tube terminates where it enters the body and communicates with the interior of the body at that point. The body itself is cylindrical and includes an externally threaded portion 16 upon which mounting nuts 17, 18 are mounted. Air vent openings 19 are formed in the side wall of the body near the top of the inlet tube 12. Body 11, inlet tube 12 and outlet tube 13 are formed as a unitary structure, and in the preferred embodiment this structure is fabricated of virgin vinyl by a moulding process.

A deflector cap 21 is removably mounted in the upper portion of body 11. This cap includes an arcuately curved top wall 22 which is positioned above the open top of inlet tube 12 and a depending skirt 23 which extends downwardly between the side wall of the body and the upper portion of the inlet tube to a level below air vents 19. The skirt comprises a pair of generally planar side walls 24 which face the air vent openings and a pair of cylindrically curved end walls 26, 27 which are positioned between the air vent openings. The side walls of the skirt are spaced inwardly from the air vent openings, and the end walls have a slightly smaller radius of curvature than the side wall of the body and are slidably received therein. Notches 28 formed in the upper end of the body side wall receive projecting lands 29 at the upper ends of end walls 26, 27 to prevent rotation of the deflector cap within the body. End wall 27 is shorter than end wall 26, and the lower portion of end wall 27 is received in the slot 31 formed in the upper portion of the side walls of inlet tube 12 adjacent to the side wall of the body. With this structure, the upper portion of the inlet tube is totally shielded from the air vent openings, and water flowing into the device through the inlet tube is directed into the interior of body 11 and not out the air vents.

The deflector cap is secured to the body by a pair of oppositely disposed hooks 33 which are received in air vent openings 19. The hooks are formed as an integral part of the deflector cap, and they extend downwardly and outwardly from the upper portions of side walls 24. The hooks are somewhat flexible and resilient, and they deflect inwardly and return to their normal outward position as the cap is inserted into the body and the tips of the hooks enter the air vent openings.

The air gap assembly is mounted in a suitable opening in the horizontally extending deck portion 36 of a sink, with air vents 19 positioned above the deck. Mounting nuts 17, 18 are positioned on opposite sides of the deck and secure the assembly to the deck. These nuts have radially extending flanges **17*a*, 18*a* at one side thereof, and the nuts are oriented with these flanges facing toward the deck. A resilient sealing ring or rubber washer 38 is positioned between the upper surface of the deck and the flange portion of nut 18, and a friction ring or metal washer 39 is positioned between the lower surface of the deck and the flange portion of nut 17**.

A decorative cap or cover 41 is removably mounted above the sink deck. This cap comprises a cylindrical side wall 42 in which an air vent 43 is formed. Cap 41 has a diameter slightly greater than nut 18, and it is secured to the nut by means of outwardly projecting nubs 46 on the nut which mate in an interlocking relationship with an inwardly projecting flange 47 on the wall of the cap.

Deflector cap 21 and decorative cap 41 are fabricated of the same material as body 11, e.g. virgin vinyl, and cap 41 is provided with a metallic coating, e.g. chrome, on the outside thereof.

Inlet tube 12 and outlet tube 13 are provided with a plurality of relatively large external ribs 52, 53 which engage the inner walls of hoses connected thereto to retain the hoses on the tube. These ribs are conically tapered, with the larger ends of the ribs facing toward the body of the device. The ribs extend from the side walls of the tubes by a distance on the order of the thickness of the side walls.

Operation and use of the air gap assembly is as follows. Cap 41, nut 18 and rubber washer 38 are removed, and lower nut 17 is positioned to allow about one-half inch of threaded section 16 to project above the sink deck. The dishwasher outlet hose is connected to inlet tube 52, and an outlet hose is connected to outlet tube 53. These holes are secured to the tubes by external hose clamps (not shown). The assembly is then inserted into the sink deck opening from below until washer 39 and nut 17 abut against the lower side of the deck. Rubber washer 38 is then set in position, and nuts 17 and 18 are tightened. Decorative cap 41 is installed on nut 18, with opening 43 facing away from the sink. The outlet hose can be connected either directly to the waste line or to the dishwasher inlet of a garbage disposal.

Water entering inlet tube 12 under pressure from the dishwasher is deflected by deflector cap 21 into the interior of body 11, from which it drains through outlet tube 13 to the waste line. Air vents 19 prevent syphoning action which might otherwise cause an undesired backflow from the waste line to the dishwasher. Since the skirt portion of deflector cap 21 extends below the level of the air vents, the chance of leakage through the air vents when the dishwasher is draining is minimal.

It is apparent from the foregoing that a new and improved air gap assembly has been provided. While only one presently preferred embodiment has been described in detail, as will be apparent to those familiar with the art, certain changes can be made without departing from the scope of the invention as defined by the following claims.

I claim:

1. In an air gap assembly for preventing backflow from a waste line to an appliance which discharges into the waste line: a vertically extending generally cylindrical hollow body, an inlet tube for connection to the discharge outlet of the appliance extending upwardly within the body and communicating with the interior of the body through the upper portion of said tube, and outlet tube communicating with the interior of the body for connection to the waste line, a pair of diametrically opposed air vents in the body in proximity to the upper portion of the inlet tube, a deflector cap mounted on the body above the inlet tube with a depending skirt interposed between the upper portion of the tube and the air vents, said skirt extending downwardly within the body to a level below the air vents, and a pair of hooks projecting outwardly from opposite sides of the deflector cap in locking engagement with the diametrically opposed air vents for securing the deflector cap to the body.

2. The air gap assembly of claim 1 further including a pair of nuts threadedly mounted on the body for securing the assembly to the deck portion of a sink, a seal member mounted on the body between the nuts for sealing engagement with the upper surface of the deck portion of the sink, and a friction ring mounted on the body below the seal member for engagement with the lower surface of the deck portion.

3. The air gap assembly of claim 1 further including a nut threadedly mounted on the body for securing the assembly to a sink deck, a cover removably mounted on the upper portion of the body, and retainer means releasably securing the cover on the body.

4. The air gap assembly of claim 3 wherein the retainer means includes a plurality of nubs projecting outwardly from the nut, and a flange projecting inwardly within the cover.

5. The air gap assembly of claim 1 wherein the inlet tube is provided with a plurality of externally projecting ribs for engagement with a hose by which said tube is connected to the discharge of the appliance.

* * * * *